US008245359B2

(12) United States Patent
Fujihara et al.

(10) Patent No.: US 8,245,359 B2
(45) Date of Patent: Aug. 21, 2012

(54) CLIP

(75) Inventors: Shigeki Fujihara, Tokyo (JP); Hirozumi Fujiwara, Tokyo (JP)

(73) Assignee: Tokyo Kinzoku Industry Co., Ltd., Tokyo (JP)

( * ) Notice: Subject to any disclaimer, the term of this patent is extended or adjusted under 35 U.S.C. 154(b) by 377 days.

(21) Appl. No.: 12/448,640

(22) PCT Filed: Dec. 7, 2007

(86) PCT No.: PCT/JP2007/073675
§ 371 (c)(1),
(2), (4) Date: Jun. 29, 2009

(87) PCT Pub. No.: WO2008/081682
PCT Pub. Date: Jul. 10, 2008

(65) Prior Publication Data

US 2010/0037439 A1 Feb. 18, 2010

(30) Foreign Application Priority Data

Dec. 28, 2006 (JP) ..... 2006-354952

(51) Int. Cl.
*B43K 25/02* (2006.01)

(52) U.S. Cl. ..... 24/11 HC; 401/104; 24/11 R

(58) Field of Classification Search ..... 24/11 R, 24/11 HC, 11 M, 3; 401/104
See application file for complete search history.

(56) References Cited

U.S. PATENT DOCUMENTS

| | | | | |
|---|---|---|---|---|
| 276,512 | A * | 4/1883 | Webster | 24/11 P |
| 5,061,105 | A * | 10/1991 | Isoda | 401/202 |
| 5,601,376 | A * | 2/1997 | Badr et al. | 401/104 |
| 2004/0099777 | A1 | 5/2004 | Fujihara et al. | |
| 2009/0165261 | A1 * | 7/2009 | Furukawa et al. | 24/11 R |

FOREIGN PATENT DOCUMENTS

| | | |
|---|---|---|
| CH | 257748 | 10/1948 |
| DE | 77 19 280 | 10/1977 |
| DE | 297 15 554 | 11/1997 |
| FR | 910991 | 6/1946 |
| FR | 918383 | 2/1947 |
| JP | 1-8395 | 3/1989 |
| JP | 2-99692 | 8/1990 |
| JP | 2004-082533 | 3/2004 |
| JP | 2006-130800 A | 5/2006 |

OTHER PUBLICATIONS

Official Action of European Application No. 07850262.2 dated Feb. 10, 2011.

* cited by examiner

*Primary Examiner* — Robert J Sandy
(74) *Attorney, Agent, or Firm* — Bacon & Thomas, PLLC

(57) ABSTRACT

A spring part without increasing the total surface of the clip body. A part of the clip body is cut out as cutout part which is bent to form the spring part. The cutout part which is a part of the clip body is utilized as the spring part.

4 Claims, 11 Drawing Sheets

(a)

(b)

CLIP

TECHNICAL FIELD

The present invention relates to a lever-type (binder-type) clip that is capable of holding an item not only on a thin clothing item such as a clothing pocket, but also on a thicker article such as a notebook, board and the like.

The present invention more specifically relates to a clip wherein a clip body is pivotably mounted on a shaft cylinder, a cap, or another cylindrical body and elastically presses the held part against the surface of the cylindrical body using a spring force.

BACKGROUND ART

Conventionally, such a clip is manufactured by punching out a clip body (clip part) and an extension part that protrudes in the lengthwise direction in a continuous fashion, bending the extension part back along the reverse surface of the clip body to form substantially a V-shape, and mounting the distal end part on the shaft cylinder, cap, or other cylindrical body to thereby integrally form a spring part in the clip body. The clip body is made to pivot using the elastic deformation of the spring part (e.g., see Patent Document 1).

Patent Document 1: Japanese Laid-open Patent Application No. 2004-82533 (page 7, FIG. 7)

DISCLOSURE OF THE INVENTION

However, with such a conventional clip, the spring part extends from the clip body in the lengthwise direction and is integrally formed. Therefore, there is a drawback in that extra material is required for the extended portion, the punched out surface area is increased, the number of clip bodies that can be punched out from a sheet of material is reduced by a commensurate amount, and the manufacturing cost is increased.

According to a first aspect of the present invention, there is provided a spring part without widening the overall surface area of the clip body.

According to a second aspect, the present invention is intended, in addition to the first aspect, to prevent disassembly of support parts while reducing the weight of the support parts.

According to a third aspect, the present invention is intended, in addition to the first aspect, to simplify and strengthen the shape of the support parts.

According to a fourth aspect, the present invention is intended, in addition to the first aspect, to completely hide the press-fitting locations inside the clip body.

In order to achieve the aspects described above, the first aspect of the present invention is characterized in that a portion of the clip body is cut out, and the cut-out part is bent to integrally form a spring part.

As used herein, the phrase "portion of the clip body is cut out" refers to cutting away an inside portion of a punched-out clip body in the case that the clip body has been formed by punching out a sheet of material in a predetermined external shape by press machining.

The second aspect is characterized by adding to the configuration of the first aspect a configuration in which a mounting piece of the clip body and a pair of support parts protrudingly disposed on the surface of the cylinder are rotatably axially mounted and disposed so that the spring part of the clip body is inserted between the two support parts. The third aspect is characterized by adding to the configuration of the first aspect a configuration in which the support parts are disposed on the surface of the cylinder, and the spring part is arranged so that contact is not made with the support parts in the lengthwise direction of the clip body.

A fourth aspect is characterized by adding to the configuration of the first aspect a configuration in which engagement convexities and engagement concavities that fit to each other are disposed in respective facing positions on the support parts protrudingly disposed on the surface of the cylinder and on the inner surface of mounting concavities formed in the clip body, such that one or both elastically deform in accompaniment with the pressing of the clip body into the support parts of the cylinder, and the engagement convexities and engagement concavities rotatably fit together inside the mounting concavity of the clip body.

According to the first aspect of the present invention, a portion of the clip body is cut out, and the cut-out part is bent to integrally form a spring part, whereby the cut-out part as the portion of the clip body is used as a spring part.

Therefore, a spring part can be obtained without increasing the entire surface area of the clip body.

As a result, manufacturing costs are reduced because the punched-out surface area of the entire clip body can be reduced and the number of clips that can be punched out from a single sheet of material can be increased in comparison with a conventional clip in which the spring part is extended in the lengthwise direction of the clip body and integrally formed.

According to the second aspect of the present invention, in addition to the effect of the first aspect, a mounting piece of the clip body and a pair of support parts protrudingly disposed on the surface of the cylinder are rotatably axially mounted and disposed so that the spring part of the clip body is inserted between the two support parts, whereby the two support parts do not deform in a mutually approaching direction, and the axial mounting is preserved even when the support parts are formed with reduced thickness, because the spring part is inserted between the two support parts.

Therefore, disassembly can be prevented while reducing the weight of the support parts.

According to the third aspect of the present invention, in addition to the effect of the first aspect, the support parts are disposed on the surface of the cylinder, and the spring part is arranged so that contact is not made with the support parts in the lengthwise direction of the clip body, whereby the support parts do not interfere with the spring part.

Therefore, the shape of the support parts can be simplified and strengthened.

As a result, the supporting parts can be more easily molded, manufacturing costs can be reduced by a commensurate amount, and the support parts are less liable to be damaged and can be used over a long period of time.

According to the fourth aspect of the present invention, in addition to the effect of the first aspect, engagement convexities and engagement concavities that fit to each other are disposed in respective facing positions on the support parts protrudingly disposed on the surface of the cylinder and the inner surface of mounting concavities formed in the clip body that faces thereto, respectively, so that one or both elastically deform in accompaniment with the pressing of the clip body into the support parts of the cylinder.

The engagement convexities and engagement concavities rotatably fit together inside the mounting concavity of the clip body, whereby the fitting portions of the engagement convexities and engagement concavities are covered by a wall surface that surrounds the mounting concavity, and are not exposed.

Therefore, the press-fitting locations can be completely hidden in the clip body.

As a result, a high-quality product having an excellent appearance and an increased degree of freedom of design can be obtained in comparison with a product in which a hole-shaped stop part and a convex holding part are exposed on the surface of the clip body.

BEST MODE FOR CARRYING OUT THE INVENTION

Figure 1:
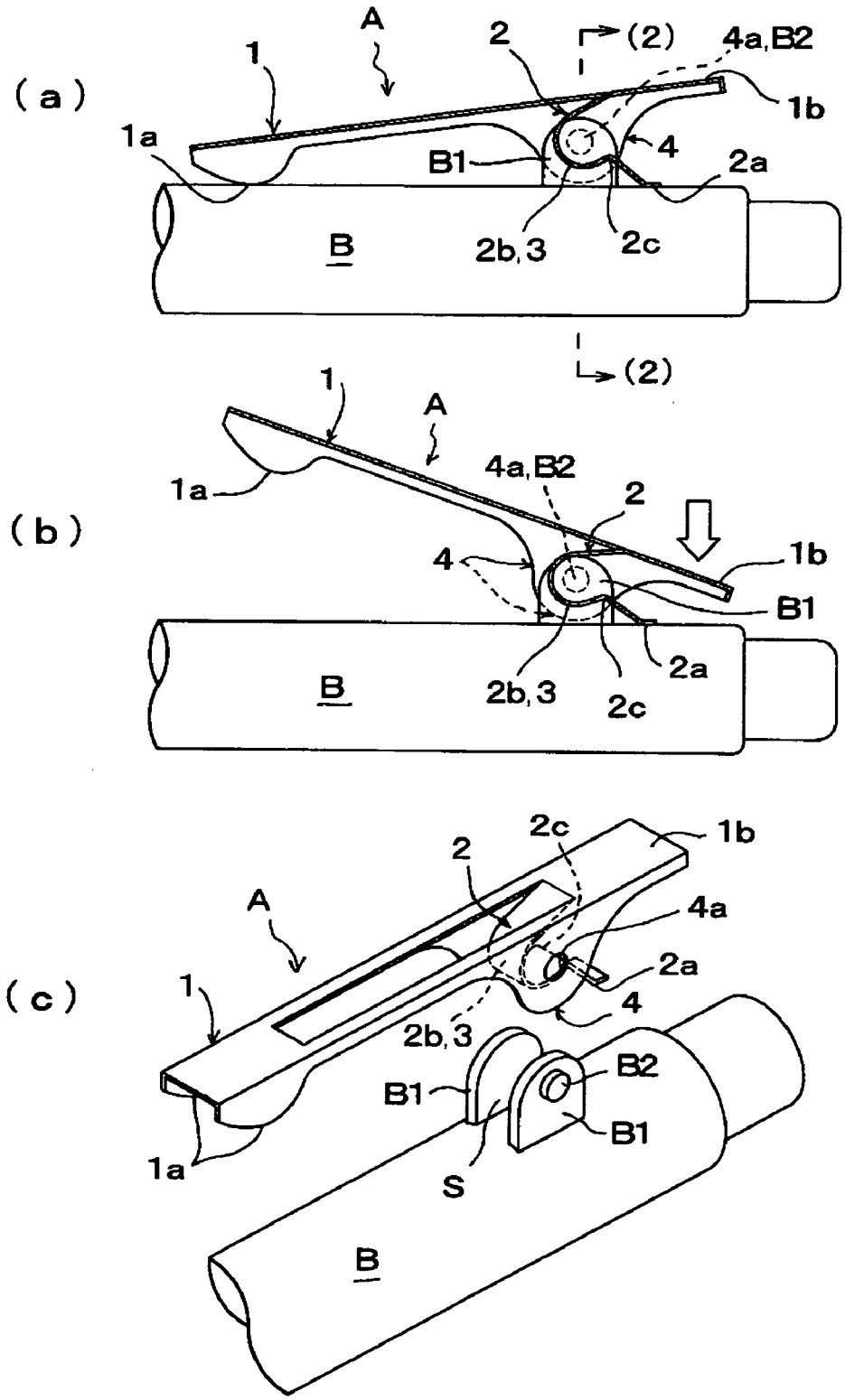
FIG. 1 show clip in accordance with a first embodiment of the present invention, wherein FIG. 1(*a*) is a front partially cutaway view in the closed state, FIG. 1(*b*) is a front partially cutaway view in the open state, and FIG. 1(*c*) is an exploded perspective view.

Clip A in accordance with the present invention is manufactured by punching out and bending a sheet of metal or another flat material (not shown) into a predetermined shape by press machining, as shown in FIGS. 1 to 14, whereby clip bodies 1 are formed into a predetermined three-dimensional shape, and each clip body 1 is pivotably mounted on a shaft cylinder, a cap, or another cylinder B in a later step.

A characteristic of the clip A in accordance with the present invention is that an inner part of the external shape of a portion of the clip body is partially cut out as part of the clip body 1 when the external shape of the clip body 1 is punched out from the sheet of material (not shown); the cut-out part 2 is bent and machined into a predetermined shape; and the distal end part 2*a* of the cut-out part is brought near to or into contact with the cylinder B, whereby the spring part 3 is integrally formed. The pincer part 1*a* formed at one end of the clip body 1 is elastically pressed against a surface of the cylinder B by the spring force of the spring part 3, and the pincer part 1*a* is set at a distance from the surface of the cylinder B by operating the operation part 1*b* formed at the opposite end of the pincer part 1*a*.

According to a specific preferred example, the inner portion substantially in the center of the clip body 1 is rectilinearly cut out in the lengthwise direction of the clip body, the rectilinear cut-out part 2 is bent substantially in the shape of a "U" or substantially in the shape of a "V" to form a bent part 2*b*, and the distal end part 2*a* is brought into direct contact with the surface of the cylinder B, or the distal end part 2*a* is brought close toward the surface of the cylinder B to make indirect contact, whereby all or a part of the entire cut-out part 2 is made to function as a spring part 3.

The clip body 1 and the cylinder B may be mounted to each other in a press-fitted configuration, a pincer configuration, or merely a rotatably axially mounted configuration in which the mounting piece 4 formed in an intermediate position in the lengthwise direction of the clip body 1, and the support parts B1 integrally formed on, or integrally secured to, the surface of the cylinder B are rotatably axially mounted in the lengthwise direction of the clip body 1. All of the clip body 1, or substantially all, excluding a part of the clip body 1, is thereby pivotably supported on the surface of the cylinder B.

According to a specific preferred example, a pair of mounting pieces 4 is formed so as to hold a mounting concavity on both sides by bending and machining the two end parts, which lie in the lateral width direction that intersects the lengthwise direction of the clip body 1, substantially parallel to the lateral direction; the support parts B1 are integrally formed or integrally provided in protruding fashion on the surface of the cylinder B so as to face each mounting piece 4; engagement holes or concavities and engagement convexities are disposed in mutually opposing positions on the left and right mounting pieces 4 and support parts B1; and the concavities and convexities are rotatably fitted to thereby pivotably axially mount the mounting pieces 4 of the clip body 1 on the support parts B1 of the cylinder B.

Embodiments in accordance with the present invention are described below with reference to the drawings.

First Embodiment

Figure 2:
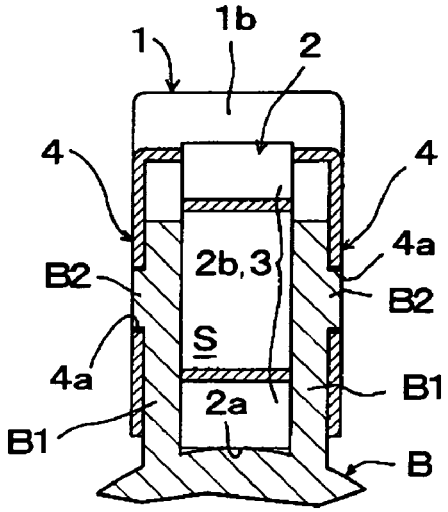
FIG. 2 is an enlarged transverse sectional side view of a clip of along line (2)-(2) of FIG. 1(*a*).

According to the first embodiment, left and right support parts B1, B1 are set as a pair at a distance from each other so as to provide a suitable interval in the lateral width direction on the surface of the cylinder B, as shown in FIGS. 1 and 2. The mounting pieces 4 of the clip body 1 are disposed so as to face the outer side of the support parts B1, B1. The outer surface of the support parts B1, B1 and the inner surface of the mounting pieces 4 are partially concavo-convexly fitted to each other and rotatably axially mounted, and the bent part 2*b* of the cut-out part 2 and the spring part 3 are inserted into the gap S between the support parts B1, B1.

In the case of the example in the drawings, the cylinder B is a shaft cylinder of a writing implement. As the means of mounting the clip body 1 described above, cylindrical engagement convexities B2 protrudingly provided to the outer surface of the support parts B1 and circular engagement holes 4*a* formed in the mounting piece 4 of the clip body 1 are rotatably fitted to each other as a pair.

Figure 3:
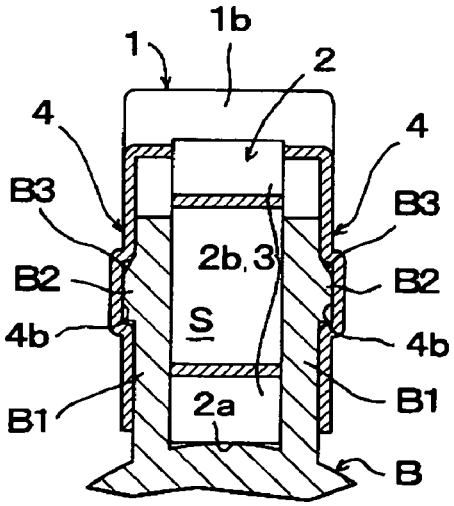
FIG. 3 is an enlarged transverse sectional side view of a clip in accordance with a modified example.

As yet another example of the mounting means, the cylindrical engagement convexities B2 protrudingly provided to the support parts B1 and the circular engagement concavities 4*b* provided to the mounting piece 4 can be rotatably fitted, as shown in FIG. 3.

In this case, the distal end surface of the engagement convexities B2 are made to slope toward the fitting/insertion direction of the mounting piece 4 in relation to the support parts B1 so that the cross-sectional shape of the distal end surface of the engagement convexities gradually increases. The mounting piece 4 is fittably inserted along the guide slope surface B3, whereby the engagement concavities 4*b* or the engagement holes 4*a* shown in FIG. 2 are outwardly spread open to the left and right and smoothly fitted onto the engagement convexities B2.

Figure 4:
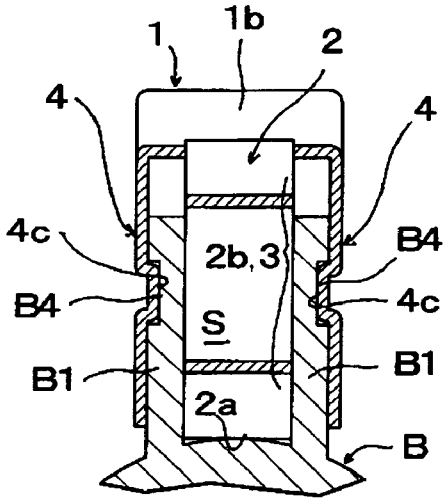
FIG. 4 is an enlarged transverse sectional side view of a clip in accordance with a modified example.

In another example, circular engagement concavities B4 provided to the support parts B1 and cylindrical engagement convexities 4*c* protrudingly provided to the mounting piece 4 can be rotatably fitted to each other, as shown in FIG. 4.

The elastic deformation center position of the spring part 3 of the clip body 1 is preferably made to substantially match the pivot parts of the support parts B1 and the mounting piece 4, which are in the pivot center position of the clip body 1, i.e., the fitting position of the engagement holes 4*a* or engagement concavities 4*b*, or the engagement convexities 4*c*, with the engagement convexities B2 or the engagement concavities B4, respectively, as shown in FIGS. 1 to 4. The spring part 3 is thereby made to flexibly and elastically deform in accompaniment with the pivoting of the clip body 1.

An advantage is thereby provided in that the clip body 1 can be smoothly opened and closed without perception of resistance.

In the case of the example in the drawings, the center position in the width direction of the clip body 1 is cut out in the shape of a strip that extends in the lengthwise direction, as shown in FIGS. 1(*a*) to (*c*). The cut-out part 2 is bent towards the rear end (left side of the figures) of the cylinder substantially in the shape of a "U", so that the bent end 2*c* of the cut-out part faces the rear direction (right direction in the drawings) of the cylinder B, and the portion that extends from the bent end 2*c* to the distal end part 2*a* is bent into a bulging shape and used as the spring part 3.

As a modified example of the spring part 3, the portion that extends from the bent end 2*c* to the distal end part 2*a* may be overall bent substantially in the shape of a "U" or substantially in the shape of a "V" without being bent in a bulging shape.

Next, the operation of the clip A will be described.

First, in a state in which the operation part 1*b* on the rear-end side of the clip body 1 shown in FIG. 1(*a*) is not pressed, the pincer part 1*a* of the front-end side of the clip body 1 is elastically pressed against, and brought into contact with, the surface the cylinder B by the spring force of the spring part 3.

From this state, the spring part 3 elastically deforms when the operation part 1*b* of the clip body 1 is pressingly operated toward the cylinder B in the manner shown in FIG. 1(*b*), and the entire clip body 1 pivots about the center of the engagement convexities B2 and the engagement holes 4*a*, which are the pivot parts between the mounting piece 4 and the support parts B1. As the pincer part 1*a* of the clip body moves away from the surface of the cylinder B, clip A can be held in place not only a clothing pocket or another thin clothing item, but also notebooks, boards, and other thicker items.

Second Embodiment

The second embodiment has a configuration that differs from the first embodiment shown in FIGS. 1 and 2 or FIGS. 3 and 4 in that one integral support part B1 is provided in a protruding fashion on the surface of the cylinder B without forming two support parts separately at a distance in the lateral width direction, and the spring part 3 and the bent part 2*b* of the cut-out part 2 are disposed so as not to contact the support parts B1 in the lengthwise direction of the clip body 1. The rest of the configuration may be the same as that of the first embodiment.

Specifically, the cut-out part 2 is bent to form a bent part 2*b* rearward from the engagement convexities B2 and the engagement holes 4*a*, which are the pivot parts between the mounting piece 4 and the support parts B1, so as to avoid interference with the support parts B1.

In the example in the drawings, in a state in which the clip body 1 and the cylinder B are mounted, a portion further forward than the support parts B1 of the clip body 1 is cut out and bent substantially in the shape of a "U" or substantially in the shape of a "V" from the rear-end portion of the cut-out part 2 toward the surface of the cylinder B; a gap is formed between the bent part 2*b* and the support part B1; and the parts are arranged so as to completely prevent any contact with each other.

Figure 12:
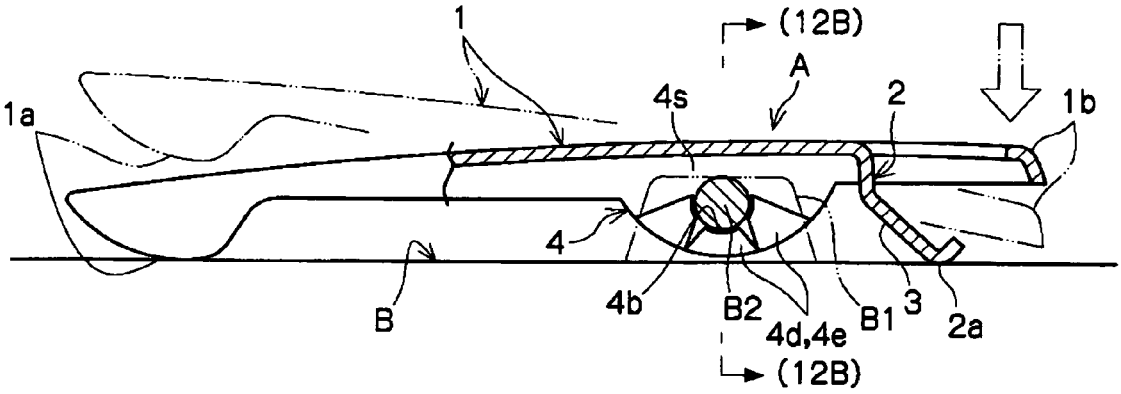
FIG. 12(*a*) is partial cutaway front view of a clip in accordance with a ninth embodiment of the present invention, and FIG. 12(*b*) is an enlarged transverse sectional front view of a clip along line (12B)-(12B) of FIG. 12(*a*).
Figure 12:
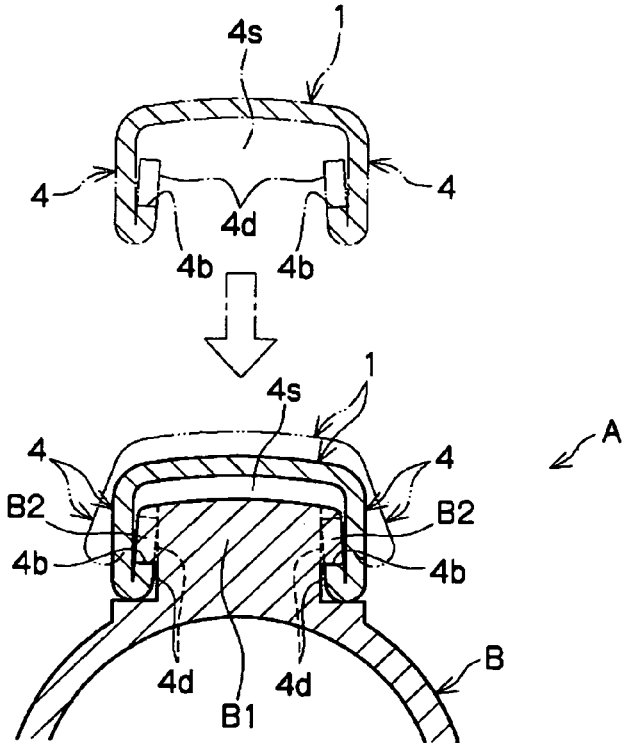

As another example, the rear portion of the clip body 1 can be cut out and bent from the front-end portion of the cut-out part 2 and made to make contact with the surface of the cylinder B, as shown in FIGS. 12(*a*), 13, and 14.

Although not shown, it is possible to form a concavity in a part of the rear-side surface of the support part B1 and to dispose the bent part 2*b* of the cut-out part 2 so that the bent part partially enters into the concavity.

Figure 5:
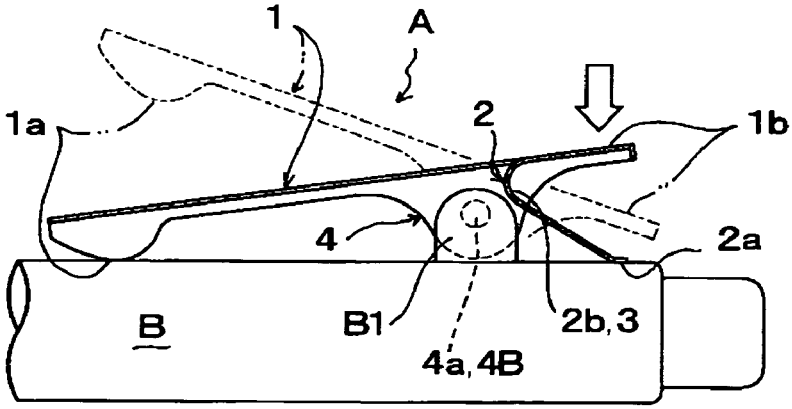
FIG. 5 is a longitudinal partial cutaway front view of a clip in accordance with a second embodiment of the present invention.

Therefore, the second embodiment shown in FIG. 5 provides the same effect as that of the first embodiment. Moreover, as additional advantages, support part B1 of the cylinder B is integrally formed. Therefore, a pair of support parts disposed separately from each other in the lateral width direction as in the first embodiment is not required. Consequently, the shape of the support part B1 is simplified, the support parts B1 can be easily molded, and the support part B1 has excellent strength and is not liable to damages.

Third Embodiment

Figure 6:
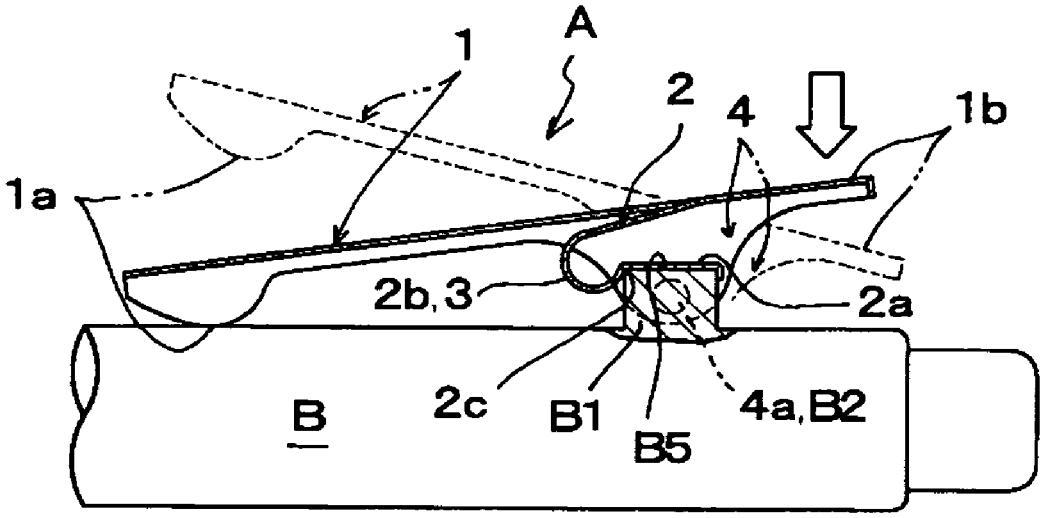
FIG. 6 is a longitudinal partial cutaway front view of a clip in accordance with a third embodiment of the present invention.

The third embodiment, as shown in FIG. 6, has a configuration that differs from the first embodiment shown in FIGS. 1 and 2 or FIGS. 3 and 4 in that the distal end part 2*a* of the cut-out part 2 is brought into contact and interlocked with a protruding end surface B5 of the support parts B1 of the cylinder B, whereby all or a part of the cut-out part 2 is integrally formed so as to function as the spring part 3. The rest of the configuration may be the same as that of the first embodiment.

In the case of the example in the drawings, the bent part 2*b* of the cut-out part 2 is bent to an angle that is equal to or greater than a semicircular arc as viewed facing the drawings; and the portion from the bent end 2*c* to the distal end part 2*a* is bent in a planar manner, is made to fit the protruding end surface B5 of the cylinder B, and is thereby immovably positioned.

As another example, the distal end part 2*a* of the cut-out part 2 can be provided with another shape and brought into contact and interlocked with the protruding end surface B5 of the cylinder B.

Thus, the third embodiment shown in FIG. 6 provides the same effect as that of the first embodiment. Moreover, as additional advantages, the support part B1 of the cylinder B may be integrally formed, and a pair of support parts disposed separately from each other in the lateral width direction as in the first embodiment is not required. Therefore, the support parts B1 can be easily molded, have excellent strength, and are not liable to damages.

In the case of the example in the drawings, the bend diameter of the spring part 3 is greater than that of the first embodiment. Therefore, there is an advantage in that permanent strain in accompaniment with the elastic deformation can be reduced, whereby restorative force is increased, and durability is improved.

Fourth Embodiment

Figure 7:
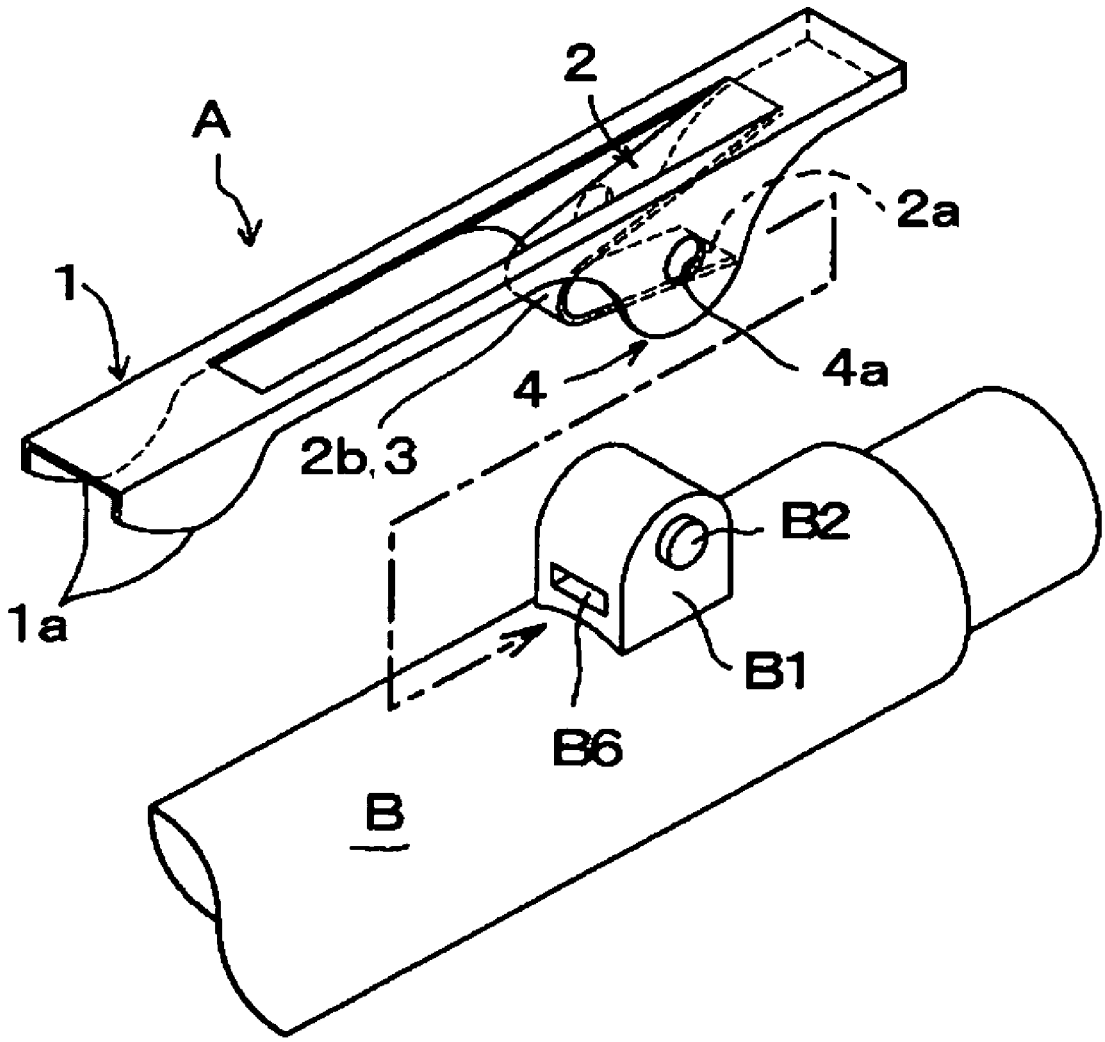
FIG. 7 is an exploded perspective view of a clip in accordance with a fourth embodiment of the present invention.

The fourth embodiment has a configuration that differs from the first embodiment shown in FIGS. 1 and 2 or FIGS. 3 and 4 in that the distal end part 2*a* of the cut-out part 2 is inserted and brought into contact with a hole B6 formed in the support part B1 of the cylinder B, whereby all or a part of the cut-out part 2 is integrally formed so as to function as the spring part 3, as shown in FIG. 7. The rest of the configuration may be the same as that of the first embodiment.

Therefore, the fourth embodiment shown in FIG. 7 provides the same effect as that of the first embodiment, and has additional advantages in that the support part B1 of the cylinder B may be integrally formed, and a pair of support parts is not required to be disposed separately from each other in the lateral width direction as in the first embodiment. Therefore, the support parts are not liable to be damaged.

Fifth Embodiment

Figure 8:
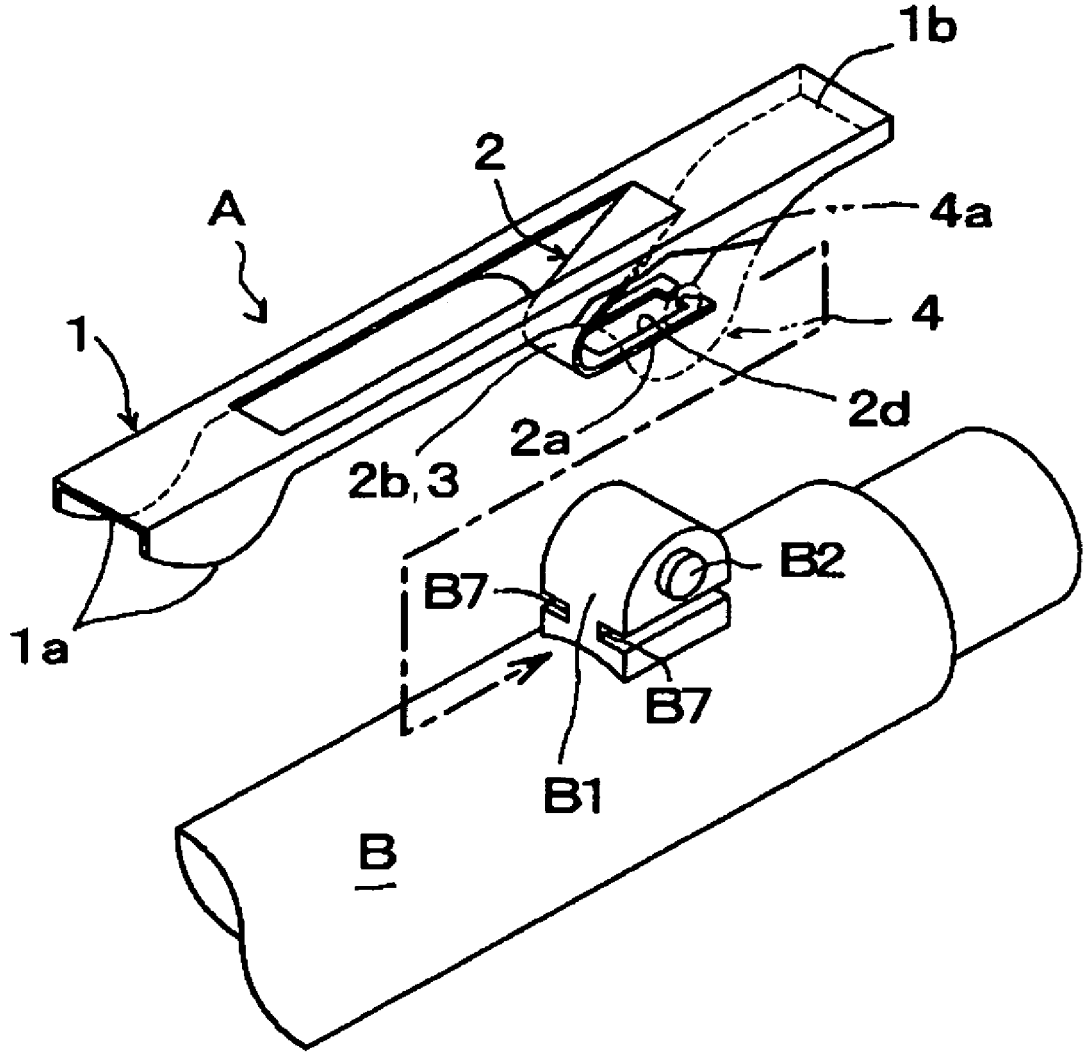
FIG. 8 is an exploded perspective view of a clip in accordance with a fifth embodiment of the present invention.

The fifth embodiment, as shown in FIG. 8, has a configuration that differs from the first embodiment shown in FIGS. 1 and 2 or FIGS. 3 and 4 in that the distal end part 2*a* of the cut-out part 2 is branched into two parts, and the branched portions 2*d* are fittably inserted into and brought into contact and interlocked with a pair of concave grooves B7 provided to the support part B1 of the cylinder B, whereby all or a part of the cut-out part 2 is integrally formed so as to function as the spring part 3. The rest of the configuration may be the same as that of the first embodiment.

Thus, the fifth embodiment shown in FIG. 8 provides the same effect as that of the first embodiment. Moreover, as additional advantages, the support part B1 of the cylinder B may be integrally formed, and a pair of support parts is not required to be disposed separately from each other in the lateral width direction as in the first embodiment. Therefore, the support part has excellent strength and is not liable to be damaged.

Sixth Embodiment

Figure 9:
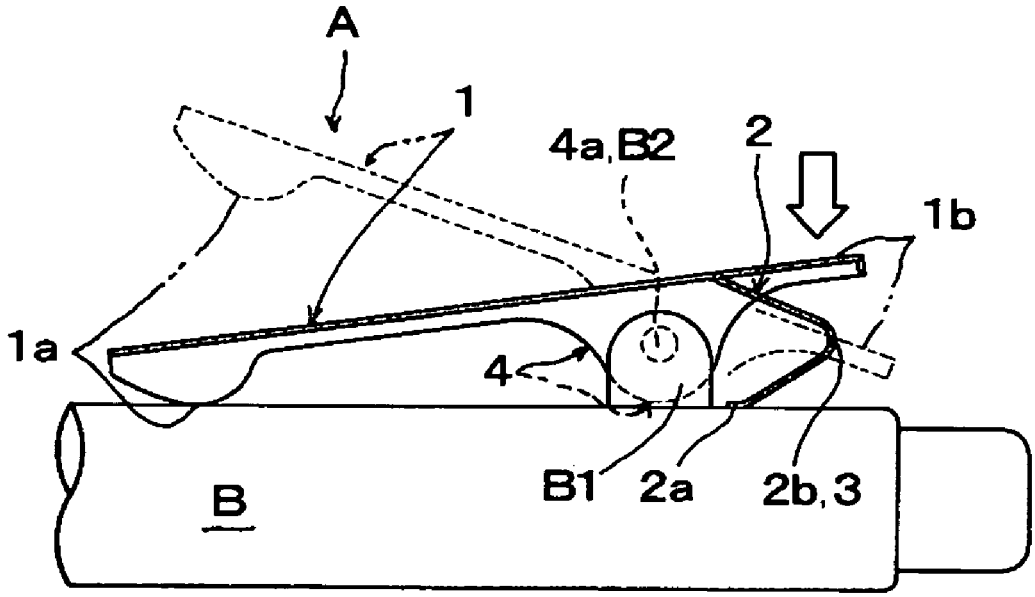
FIG. 9 is a longitudinal partial cutaway front view of a clip in accordance with a sixth embodiment of the present invention.

The sixth embodiment, as shown in FIG. 9, has a configuration that differs from the first embodiment shown in FIGS. 1 and 2 or FIGS. 3 and 4, as well as from the second to sixth embodiments in that the bent part 2*b* is formed by bending from the base portion of the cut-out part 2 substantially in the shape of a "V" in the rearward direction of the cylinder B, and bending from this location substantially in the shape of a "U" or substantially in the shape of a "V" so that the bent part 2*b* protrudes rearward, and the distal end part 2*a* is brought into direct contact with the surface of the cylinder B in the forward direction of the cylinder B or is brought close to the surface of the cylinder B so as to make indirect contact, whereby all or a part of the cut-out part 2 is integrally formed so as to function as the spring part 3. The rest of the configuration may be the same as that of the first embodiment as well as the second to fifth embodiments.

Thus, the sixth embodiment shown in FIG. 9 provides the same effect as that of the first to fifth embodiments. Moreover, as additional advantages, the distal end part 2*a* of the cut-out part 2 is disposed, as shown in the drawing, further rearward than the engagement convexities B2 and the engagement holes 4*a*, which are the pivot parts between the mounting piece 4 of the clip body 1 and the support parts B1 of the cylinder B. Accordingly, the distal end part 2*a* does not displace itself in the lengthwise direction (axial direction) of the cylinder B even when the cut-out part 2 is elastically deformed by pressing and operating the operation part 1*b* at the rear end of the clip body 1. Thus the clip body 1 can be smoothly opened and closed without perception of resistance.

Seventh Embodiment

Figure 10:
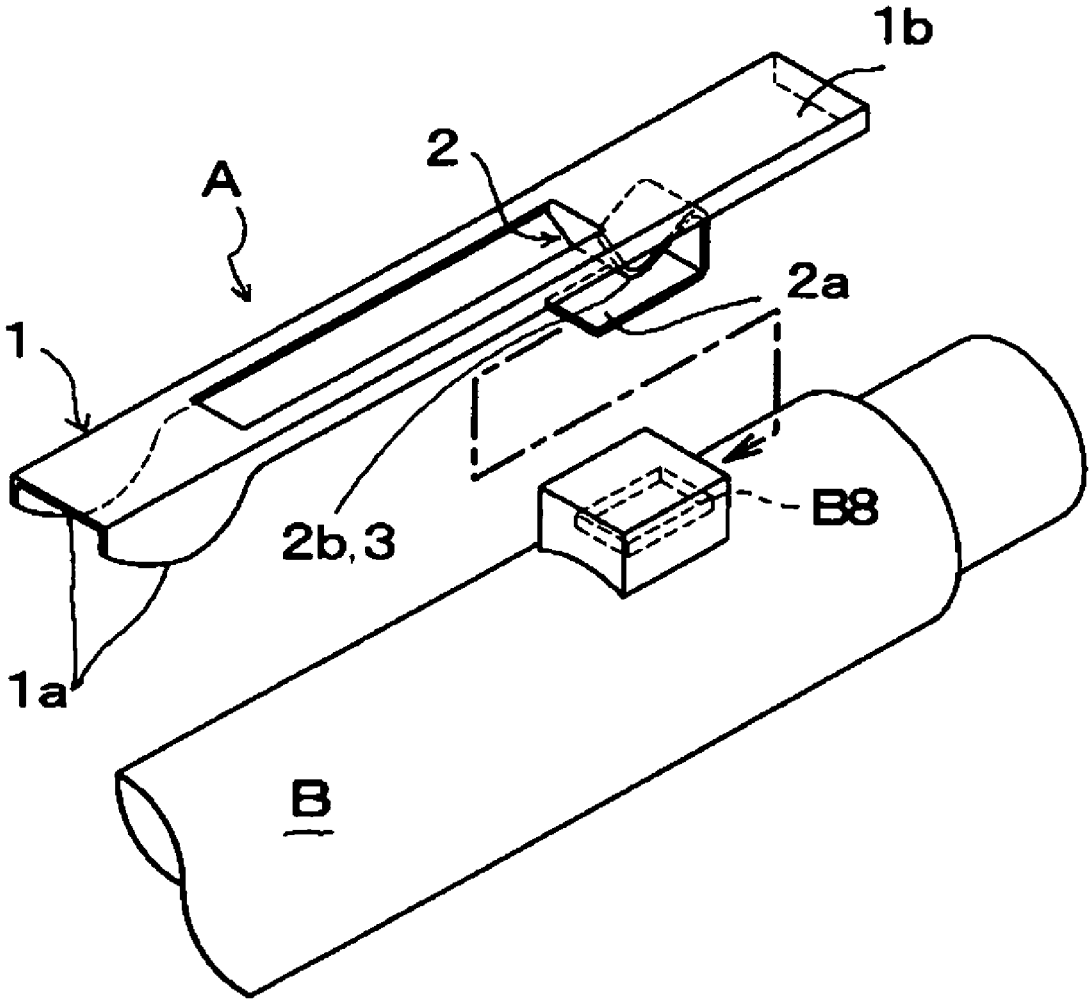
FIG. 10 is an exploded perspective view of a clip in accordance with a seventh embodiment of the present invention.

The seventh embodiment, as shown in FIG. 10, has a configuration that differs from the first embodiment shown in FIGS. 1 and 2 or FIGS. 3 and 4, as well as from the second to sixth embodiments, and the axially mounted structure of the mounting pieces 4 of the clip body 1 and the support parts B1 of the cylinder B. Instead a press-fitted structure is taken such that the distal end part 2*a* of the cut-out part 2 is fittably inserted into a stop hole B8 formed as part of the cylinder B, and is pressed so as to thereby be prevented from moving in the axial direction of the cylinder B. The rest of the configuration may be the same as that of the first embodiment as well as the second to sixth embodiments.

In the example in the drawing, the distal end part 2*a* of the cut-out part 2 protrudes forward of the cylinder B and is pressed into the rearward-opening stop hole B8.

As another example (not shown) in a converse fashion, the distal end part 2*a* of the cut-out part 2 can be made to protrude in the rearward direction of the cylinder B and pressed into the forward-opening stop hole B8 of the cylinder B.

As required, a saw-toothed retaining pawl may be formed at the distal end part 2*a* of the cut-out part 2.

Furthermore, in the example shown in the drawing, the bent part 2*b* bent in the rearward direction of the cylinder B from the base portion of the cut-out part 2 and bent from this location substantially in the shape of a "U" or substantially in the shape of a "V" is formed in a continuous fashion.

The bent shape may be modified to a shape other than that shown in the drawing. For example, the bent part 2*b*, which is bent in the forward direction of the cylinder B from the base portion of the cut-out part 2 and bent from this location substantially in the shape of a "U" or substantially in the shape of a "V," may be formed in a continuous fashion.

Thus, the seventh embodiment shown in FIG. 10 provides the same effect as that of the first to sixth embodiments described above.

Eighth Embodiment

Figure 11:
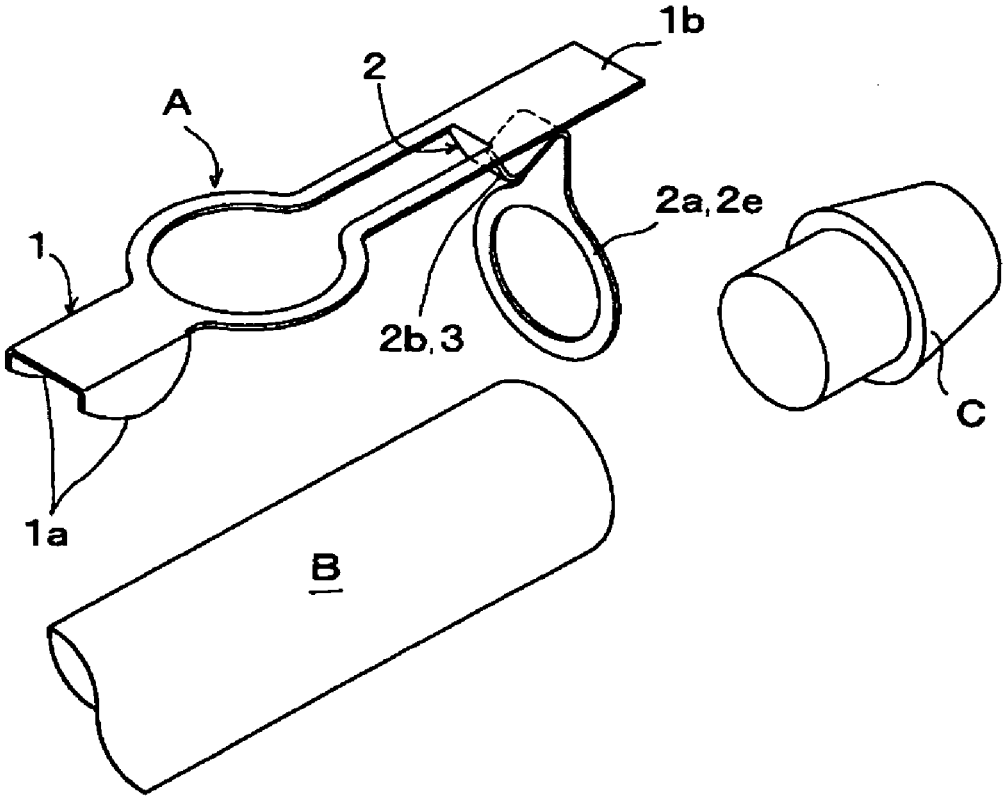
FIG. 11 is an exploded perspective view of a clip in accordance with an eighth embodiment of the present invention.

The eighth embodiment, as shown in FIG. 11, has a configuration that differs from the first embodiment shown in FIGS. 1 and 2 or FIGS. 3 and 4, as well as from the second to sixth embodiments with the axially mounted structure of the mounting piece 4 of the clip body 1 and the support parts B1 of the cylinder B. Instead a pincer is configured such that the distal end part 2*a* of the cut-out part 2 is formed in an annular shape (ring), and the annular part 2*e* is inserted into the cylinder B by insertably mounting a tail plug or another stop C so as to prevent movement in the axial direction of the cylinder B. The rest of the configuration may be the same as that of the first embodiment and the second to sixth embodiments.

In the example in the drawing, the bent part 2*b* bent in the rearward direction of the cylinder B from the base portion of the cut-out part 2 and bent from this location substantially in the shape of a "U" or substantially in the shape of a "V" is formed in a continuous fashion.

The bent shape may be modified to a shape other than that shown in the drawing. For example, the bent part 2*b*, which is bent in the forward direction of the cylinder B from the base portion of the cut-out part 2 and bent from this location substantially in the shape of a "U" or substantially in the shape of a "V," may be formed in a continuous fashion.

Therefore, the eighth embodiment shown in FIG. 11 provides the same effect as that of the first to sixth embodiments described above.

Ninth Embodiment

The ninth embodiment, as shown in FIGS. 12(*a*) and (*b*), has a configuration that differs from the first embodiment shown in FIGS. 1 and 2 or FIGS. 3 and 4, as well as from the second to sixth embodiment, in that the engagement convexities B2 and the engagement concavities 4*b* are set in opposing positions so as to fit each other on the inner surface of a mounting concavity 4*s* formed in the clip body 1 and on the two side surfaces of the support parts B1 protrudingly disposed on the surface of the cylinder B. One or both of the engagement convexities and the engagement concavities elastically deform in accompaniment with the pressing of the clip body 1 in relation to the support parts B1 of the cylinder B, and the engagement convexities B2 and the engagement concavities 4*b* are disposed so as to rotatably fit together inside the mounting concavity 4*s* of the clip body 1. The rest of the configuration may be the same as that of the first embodiment as well as the second to sixth embodiments.

Specifically, a pair of mounting pieces 4 and a pair of bent-back parts 4*d* that are continuous to the edge of the mounting pieces are formed when the starting sheet of the clip body 1 is punched out using a press machine or the like, and the mounting pieces 4 are each bent by machining into a "c" shape in cross section, whereby a mounting concavity 4*s* is formed between the two mounting pieces 4. The bent-back parts 4*d* are each subsequently bent back from the edge of the mounting pieces 4 toward the mounting concavity 4*s*, whereby the bent-back parts 4*d* are disposed so that each faces the support parts B1 of the cylinder B.

One of the engagement convexities B2 and the engagement concavities 4*b* is provided to the bent-back parts 4*d*, which face each other across the mounting concavity 4*s*, so as to face the two side surfaces of the support parts B1, and the other of the engagement convexities B2 and the engagement concavities 4*b* is disposed in a position that faces the two side surfaces of the support parts B1.

One or both of the support parts B1 of the cylinder B or the mounting pieces 4 of the clip body 1 are made to elastically deform, and the separately formed engagement convexities B2 and engagement concavities 4*b* are fitted onto the bent-back parts 4*d* facing the mounting concavity 4*s* and the two side surfaces of the support parts B1, whereby the clip body 1 of the cylinder B is mounted on the support parts B1 of the cylinder B with a single pressing operation so as to cover the mounting concavity 4*s* of the clip body 1.

In the example in the drawing, the engagement convexities B2 are each protrudingly provided to the two sides of the support parts B1 of the cylinder B, the engagement concavities 4*b* are each provided to the mounting concavity 4*s* of the clip body 1 facing the engagement convexities, and the single pressing operation described above is carried out, whereby the two mounting pieces 4 of the clip body 1 are each elastically pushed apart in the outward direction to allow further pressing action. The engagement concavities 4*b* fit in close contact with each of engagement convexities B2 of the support parts B1, and the mounting concavity 4*s* of the clip body 1 is pivotably mounted on the support parts B1 of the cylinder B.

A plurality of substantially trapezoidal bent pieces 4*e* is formed as the bent-back parts 4*d* that are continuous to the edge of the mounting pieces 4, and the bent pieces 4*e* are folded back so that the side surface shape of the mounting pieces 4 becomes semicircular, whereby the semicircular engagement concavities 4*b* are formed at the edge of the bent pieces 4*e*.

Figure 13:
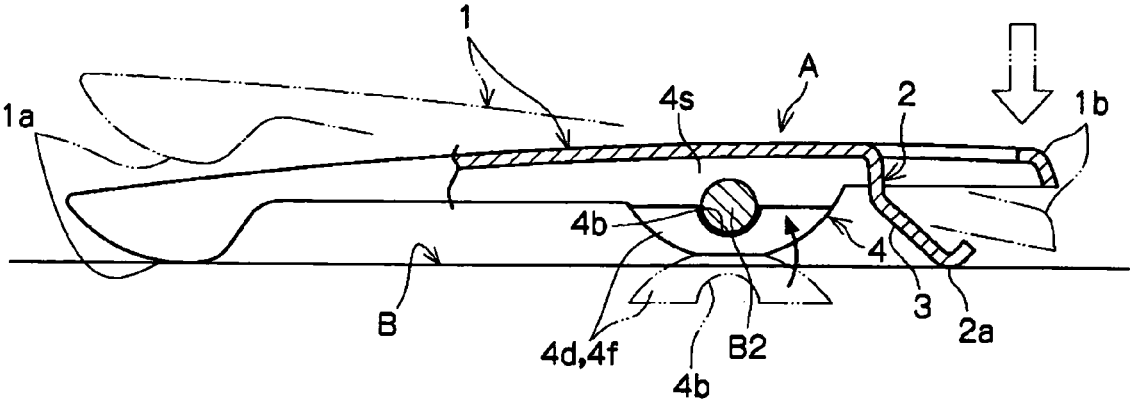
FIG. 13 is a partial cutaway front view of a clip in accordance with a modified example of the folded back part.

Another possible example of the bent-back parts 4*d* is one in which substantially semicircular bent pieces 4*f* are formed in a continuous fashion, and the bent pieces 4*f* are folded back so that the side surface shape of the mounting pieces 4 becomes semicircular, whereby the semicircular engagement concavities 4*b* are disposed at the edge of the bent pieces 4*f*, as shown in FIG. 13.

Another (not shown) possible example is one in which bent pieces 4*f* having a substantially circular, elliptical, or other shape are formed in a continuous fashion, and the bent pieces 4*f* are folded back to thereby arrange circular engagement concavities 4*b* formed in the center of the bent pieces 4*f*.

Also, the center position in the width direction of the clip body 1 is cut out in a striped shape extending in the lengthwise direction, the base portion of the cut-out part 2 is bent substantially in the shape of a "V" in the rearward direction of the cylinder B so as to form a spring part 3 of the clip body 1, and the distal end part 2*a* is caused to make direct contact with the surface of the cylinder B or is brought close to the surface of the cylinder B so as to make indirect contact, whereby all or a part of the cut-out part 2 is integrally formed so as to function as the spring part 3.

Another possible example of the spring part 3 is one in which bending is carried out in the same manner as in the first embodiment shown in FIG. 1, the second embodiment shown in FIG. 5, or the sixth embodiment shown in FIG. 9.

Therefore, the ninth embodiment shown in FIGS. 12(*a*) and (*b*) and in FIG. 13 provides the same effect as that of the first to sixth embodiments, and has additional advantages in that the fitting portions of the engagement concavities 4*b* and the engagement convexities B2 are not exposed but are covered by a wall surface that surrounds the mounting concavity 4*s* in a state in which the clip body 1 and the cylinder B are mounted. Therefore, the press-fitting locations can be completely hidden inside the clip body 1, and in the case that the bent-back parts 4*d* of the mounting pieces 4 are bent by machining toward the mounting concavity 4*s* to form the engagement concavities 4*b*, the strength of the mounting pieces 4 overall is improved and deformation is less liable to occur. Therefore, the advantage is that the clip body is less likely to move around relative to the engagement convexities B2 of the cylinder B in a mounted state, and unsteady movement is also prevented.

Tenth Embodiment

Figure 14:
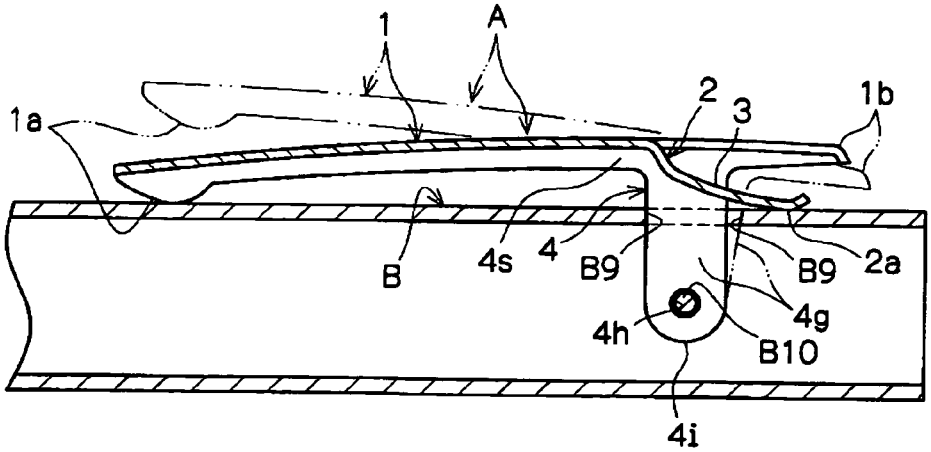
FIG. 14 is a longitudinal sectional front view of a clip in accordance with a tenth embodiment of the present invention.

The tenth embodiment has a configuration that differs from the first embodiment shown in FIGS. 1 and 2 or FIGS. 3 and 4, as well as from the second to sixth embodiment, in that through-holes B9 are formed in the surface of the cylinder B, a support shaft B10 is protrudingly provided inside the cylinder B, protruding pieces 4*g* integrally formed with the two mounting pieces 4 of the clip body 1 are inserted into the through-holes B9, and the support shaft B10 and stop holes 4*h* formed in the distal ends are interlocked, whereby the clip body 1 is pivotably mounted on the surface of the cylinder B, as shown in FIG. 14. The rest of the configuration may be the same as that of the first embodiment as well as the second to sixth embodiment.

Specifically, a pair of through-holes B9 of the cylinder B is formed with a slightly greater size than the two protruding pieces 4*g* of the clip body 1, and the support shaft B10 is protrudingly provided so as to intersect the pressing direction of the clip on the line extending in the insertion direction of the two protruding pieces 4*g* of the clip body 1 in relation to the through-holes B9.

It is preferred that a pair of the support shafts B10 be disposed at a distance from each other so as to hold the protruding pieces 4*g* of the clip body 1 on both sides, and the facing surfaces of the support shafts B10 each be sloped so as to gradually approach the clip pressing direction.

When the two protruding pieces 4*g* of the clip body 1 are pressed into the through-holes B9 of the clip body 1 to be rotatably axially mounted, the distal edges 4*i* of the protruding pieces 4*g* make contact with the sloped opposing surfaces of the support shafts B10 and slide along the surfaces, whereby the two protruding pieces 4*g* are elastically deformed in the mutually approaching directions, and the two protruding pieces 4*g* widen due to the elastic restorative force and interlock with the support shafts B10 when the stop holes 4*h* at the distal ends of the pieces reach the support shafts.

Another possible example is one in which a portion between the clip body 1 and the two protruding pieces 4*g* is bent by machining or the like in lieu of or in addition to the slope of the opposing surfaces of the support shafts B10, and when pressed into the through-holes B9 of the cylinder B, the two protruding pieces 4*g* open due to the elastic restorative force inside the cylinder B, and the stop holes 4*h* at distal ends of protruding pieces are interlocked with the support shafts B10.

Therefore, the tenth embodiment shown in FIG. 14 provides the same effect as that of the first to sixth embodiments, and has additional advantages in that the protruding pieces 4*g* of the clip body 1 are pressed into the through-holes B9 of the cylinder B, and the clip is thereby axially mounted when the stop holes 4*h* in the distal ends of the protruding pieces become interlocked with the support shafts B10 inside the cylinder B. Therefore, the clip can be mounted on the cylinder B in a simple manner by merely pressing on the clip body 1.

In the examples in the drawings, the case was described in which the cylinder B is a shaft cylinder of a writing implement, but no limitation is imposed thereby, and the invention is applicable to a shaft cylinder of an item other than a writing implement, a cap into which the shaft cylinder is detachably inserted, or a cylinder of an item other than a writing implement.

Also, the case was described in which the support parts B1 are integrally formed on the surface of the cylinder B, but no limitation is imposed thereby, and support parts B1 formed apart from the cylinder B may be mounted, bonded, or otherwise secured to the surface of the cylinder B to integrate the two together.

EXPLANATION OF REFERENCES

A: clip
B: cylinder
B1: support part
B2: engagement convexity
1: clip body
1*a*: pincer part
2: cut-out part
3: spring part
4: mounting piece
4*b*: engagement concavity
4*s*: mounting concavity

The invention claimed is:

1. A clip comprising:

a cylinder, a clip body (1) having a pincer part (1*a*), said pincer part movable towards and away from said cylinder, and a mount which is arranged between said cylinder (B) and said clip body (1), and rotatably mounts said cylinder (B) and said clip body (1), wherein an inside part of said clip body (1) is cut out from a central portion of said clip body to integrally form a cut-out part (2) which is bent to configure a spring portion (3), and a distal end part (2*a*) is brought into contact with a surface of said cylinder (B) so that said pincer part (1*a*) of said cylinder is elastically pressed into contact with said cylinder (B); and wherein said mount is arranged between said pincer part (1*a*) of said clip body (1) and said spring portion (3), wherein said mount rotatably mounts a mounting piece (4) formed to said clip body (1) and a support part (B1) which is protrudingly arranged on said surface of said cylinder (B).

2. The clip as recited in claim 1, wherein said support part (B1) of said cylinder (B) and said spring portion (3) are arranged to be separate in the longitudinal direction of said clip body (1).

3. The clip as recited in claim 2, wherein said support part (B1) of said cylinder (B) includes one of an engagement convexity or an engagement concavity, and an inner surface of a mounting cavity (4*s*) formed to said clip body includes the other one of said engagement convexity (B2) and said engagement concavity (4*b*), said engagement convexity and said engagement concavity disposed in respective facing positions and rotatably fitting to each other inside said mounting cavity (4*s*) of said clip body (1) by elastically deforming one or both of said engagement convexity (B2) and said engagement concavity (4*b*) in accompaniment with pressing of said clip body (B) to said support part (B1).

4. The clip as recited in claim 1, wherein said support part (B1) of said cylinder (B) includes one of an engagement convexity or an engagement concavity, and an inner surface of a mounting cavity (4*s*) formed to said clip body includes the other one of said engagement convexity (B2) and said engagement concavity (4*b*), said engagement convexity and said engagement concavity disposed in respective facing positions and rotatably fitting to each other inside said mounting cavity (4*s*) of said clip body (1) by elastically deforming one or both of said engagement convexity (B2) and said engagement concavity (4*b*) in accompaniment with pressing of said clip body (B) to said support part (B1).

* * * * *